US008627682B2

(12) United States Patent
Christodoulou

(10) Patent No.: US 8,627,682 B2
(45) Date of Patent: Jan. 14, 2014

(54) MODULAR JEWELRY

(75) Inventor: Kleanthis Christodoulou, East Brunswick, NJ (US)

(73) Assignee: K.M. Design Jewels, Inc., East Brunswick, NJ (US)

( * ) Notice: Subject to any disclaimer, the term of this patent is extended or adjusted under 35 U.S.C. 154(b) by 64 days.

(21) Appl. No.: 13/430,397

(22) Filed: Mar. 26, 2012

(65) Prior Publication Data

US 2013/0247613 A1 Sep. 26, 2013

(51) Int. Cl.
*A44C 25/00* (2006.01)

(52) U.S. Cl.
USPC ..... 63/35; 63/26; 63/28; 63/30

(58) Field of Classification Search
USPC ..... 63/35, 30, 28, 26, 39, 29.1; 29/10
See application file for complete search history.

(56) References Cited

U.S. PATENT DOCUMENTS

| | | | | | |
|---|---|---|---|---|---|
| 859,162 | A * | 7/1907 | Worth | 63/30 |
| 1,186,271 | A * | 6/1916 | Block | 63/15.2 |
| 3,075,367 | A | 1/1963 | Goodman | |
| 3,606,696 | A * | 9/1971 | Berman | 446/479 |
| D247,881 | S | 5/1978 | Hitchens | |
| 4,353,225 | A | 10/1982 | Rogers | |
| 4,400,932 | A | 8/1983 | Epstein | |
| 4,406,296 | A | 9/1983 | Wexler et al. | |
| 4,763,489 | A | 8/1988 | Strong | |
| 4,879,882 | A | 11/1989 | Johnson et al. | |
| 4,936,115 | A * | 6/1990 | Mesica | 63/26 |
| 4,977,757 | A * | 12/1990 | Mesica et al. | 63/15 |
| 5,096,169 | A | 3/1992 | Behnke | |
| 5,157,945 | A * | 10/1992 | Giehl | 63/33 |
| 5,203,057 | A | 4/1993 | Runnels | |
| 5,524,458 | A * | 6/1996 | Buchner | 63/28 |
| 5,865,042 | A | 2/1999 | Cerqua | |
| 6,220,010 | B1 | 4/2001 | Gomez | |
| 6,446,466 | B1 | 9/2002 | Headley | |
| 7,216,508 | B2 | 5/2007 | Kretchmer et al. | |
| 7,454,924 | B2 * | 11/2008 | Grad | 63/28 |
| 2002/0000097 | A1 * | 1/2002 | Butler | 63/26 |
| 2008/0289363 | A1 * | 11/2008 | Langford | 63/1.16 |
| 2011/0132036 | A1 * | 6/2011 | Meltzer | 63/29.1 |
| 2012/0011888 | A1 | 1/2012 | Patterson | |

FOREIGN PATENT DOCUMENTS

| | | | | |
|---|---|---|---|---|
| EP | 276183 A1 * | 7/1988 | | A44C 17/04 |

* cited by examiner

*Primary Examiner* — Emily Morgan
(74) *Attorney, Agent, or Firm* — Cozen O'Connor

(57) ABSTRACT

A jewelry system includes a first screw end, a first base, a second base, a screw wire and second screw end. The first and second screw ends are connected to respective ends of the screw wire. The first and second bases include receiving holes for receiving the screw wire. One or more sides extending from the first base include a cutout, and one or more sides extending from the second base corresponding to the side or sides of the first base including the cutouts include corresponding a cutout. The sides of the first base and the sides of the second base are configured to be connected together between the one or more cutouts, and corresponding cutouts of the first base and the second base form receiving areas when combined together. Each receiving area is configured to hold a gem stone or other decorative item when the first base and the second base are connected together.

18 Claims, 2 Drawing Sheets

MODULAR JEWELRY

FIELD OF THE INVENTION

The present invention is related to a jewelry system. In particular, example embodiments are directed to a jewelry system including various jewelry components that are easily combinable to form jewelry articles having various decorative items and/or differing shapes and sizes, and which are easily modifiable.

BACKGROUND OF THE INVENTION

Jewelry articles are typically made of different types of precious metals and stones and are held together by mechanical linkages or interconnections. Designers are somewhat limited by these connections, which often cannot be modified after completion of the jewelry article or cannot be modified without extensive work by a jeweler.

Customers often desire personalized jewelry that includes astrological birth stones, names or significant dates and other personally selected or decorative items. Moreover, customers may want their personalized jewelry to have a particular size and/or shape. However, a jeweler is not likely to be able to stock all of the many variations that may be desired by customers, and it is inconvenient for customers to wait for the jeweler to modify an already existing piece of jewelry or to create a new piece of jewelry for the customer using conventional jewelry components.

Furthermore, a customer may purchase a piece of jewelry that meets their needs or desires at one point in time, but which the customer will want to modify or supplement at a later point in time. For example, a customer may purchase a piece of jewelry that initially includes birthstones representing each of their children and, at a point in time after purchasing the jewelry, have another child. Accordingly, the customer may wish to augment the jewelry they already own to include an additional birthstone or other elements representing their new child. In another example, a person may own a piece of jewelry that is originally intended to be worn as a pendant on a necklace; however, the customer may want to modify a size and/or shape of the jewelry so that it may be worn as a different article of jewelry, e.g., an earring. In still another example, a person may own a piece of jewelry that they wish to frequently modify. For example, the person may wish to have a jeweler be able to easily swap out red gem stones for green or blue gem stones in order to change the jewelry for different occasions.

Conventional jewelry cannot be easily modified or augmented, and even if such modification or augmentation can be performed by a jeweler it is often time intensive and expensive. Accordingly, there exists a need for a jewelry system that includes components that are easily combinable to create new jewelry articles which are easily modifiable after their creation by persons who are not trained jewelers.

SUMMARY OF THE INVENTION

It is an objective of the present invention to provide a jewelry system including components that are easily combinable to create new jewelry articles which are easily modifiable to increase or decrease the size and/or decorative aspects thereof after creation.

According to an example embodiment, a jewelry system includes a first screw end, a first base, a second base, a screw wire and second screw end. The first and second screw ends are connected to respective ends of the screw wire. The first and second bases include receiving holes for receiving the screw wire. One or more sides extending from the first base include a cutout, and one or more sides extending from the second base corresponding to the side or sides of the first base including the cutout include a corresponding cutout. The sides of the first base and the sides of the second base are configured to be connected together between the one or more cutouts, and corresponding cutouts of the first base and the second base are combined to form receiving areas when combined together. Each receiving area is configured to hold a gem stone or other decorative item when the first base and the second base are connected together.

According to another example embodiment, a middle link including a receiving hole for receiving the screw wire is configured to be slid onto the screw wire between the first and second bases.

According to still another example embodiment, a plurality of middle links are configured to be slid onto the screw wire between the first and second bases.

According to a further example embodiment, a process for forming an article of jewelry comprises connecting a first screw end to one end of a screw wire, sliding the screw wire through holes in a first base and a second base and connecting a second screw end to the opposite end of the screw wire.

BRIEF DESCRIPTION OF THE DRAWINGS

The above and/or other aspects and advantages will become more apparent and more readily appreciated from the following detailed description of embodiments of the invention taken in conjunction with the accompanying drawings, of which.

DETAILED DESCRIPTION OF THE DRAWINGS

Figure 1:
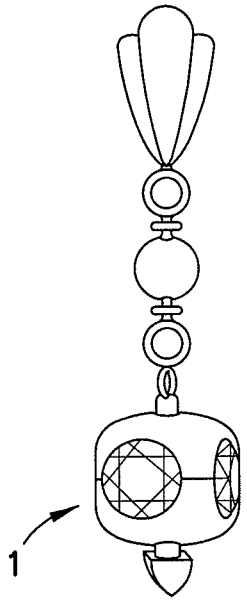
FIGS. 1A and 1 show exploded and assembled perspective views of a modular jewelry system according to an example embodiment.
Figure 1A:
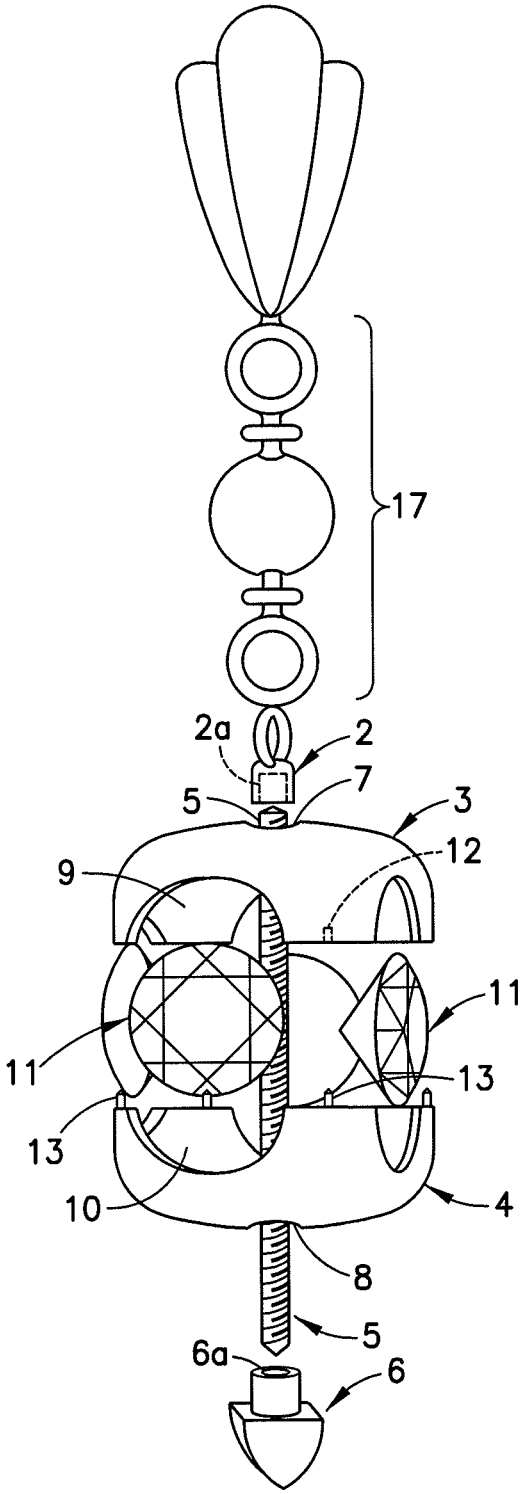

As shown in FIGS. 1A and 1 (collectively referenced as "FIG. 1 unless separately identified), a jewelry system 1 according to an example embodiment comprises a first screw end 2, a first base 3, a second base 4, a screw wire 5 and a second screw end 6.

The first and second screw ends 2 and 6 include threaded female receivers 2*a* and 6*a* for receiving the screw wire 5. The screw wire 5 is a threaded rod having a desired or predetermined diameter and length. The screw ends 2 and 6 and the screw wire 5 are sized and configured such that the screw wire 5 can be screwed into the female receivers 2*a* and 6*a* to secure the screw ends 2 and 6 to respective ends of the screw wire 5.

The first and second screw ends 2 and 6 may include various different configurations opposite the female receivers 2*a* and 6*a*. For example, the first screw end 2 is shown in FIG. 1 as having a loop for connection to another jewelry component opposite its female receiver 2*a*, and the second screw end 6 is shown in FIG. 1 as having a pyramid shaped portion opposite its female receiver 6*a*. For example, the pyramid shaped portion may be configured to sit in an assembly base (not shown) which holds the second screw end 6 upright to facilitate assembly of the jewelry system 1. However, example embodiments are not limited thereto and the screw ends 2 and 6 may have various other fastening or connection elements, such as, another female receiver, a male connection, a clasp etc., or various other shaped portions having other shapes, functional elements or decorative elements opposite the female receivers.

If the first screw end 2 or the second screw end 6 comprises a loop for connection to another jewelry component opposite its female receiver, the another jewelry component connected thereto may be a rotating bead 17 as shown in FIG. 1. The rotating bead may comprise a bead on a wire with connectors at each end of the wire for connection to other jewelry components, such as the first screw end 2. The bead is rotatable about the wire, which allows the remainder of the jewelry system 1 to rotate relative to the rotating bead 17. The rotating bead 17 may further comprise two rotating connectors (not shown) at the end of the bead opposite the connection to the first screw end 2. Each of the two rotating connectors may be connected to one end of a necklace string such that the assembled jewelry system may be worn as a pendant on the necklace string.

The first base 3, which may be arranged proximate one end of the screw wire and directly adjacent to the first screw end 2, comprises an upper surface having sides extending therefrom in an axial direction of the screw wire 5, i.e., in a direction toward the second base 4 arranged proximate the opposite end of the screw wire and directly adjacent to the second screw end 6.

The upper surface of the first base 3 includes a receiving hole 7. The receiving hole 7 is sized and configured to receive the screw wire 5. The hole 7 can be sized and configured to allow the first base 3 to axially rotate around the screw wire 5 outside of the threads of the screw wire 5.

The second base 4 comprises of a lower surface having sides extending therefrom in an axial direction of the screw wire 5, i.e., in a direction toward the first base 3 arranged at the one end of the screw wire and directly adjacent to the first screw end 2. Accordingly, when the first base 3 and the second base 4 are placed opposite one another, their respective sides extend toward each other along the axial direction of the screw wire 5.

FIG. 1 shows the first base 3 and the second base 4 having generally cap or bowl shapes with four sides gradually curving in the axial direction of the screw wire 5 from the upper/lower surface. Connections between each of the sides of a base may be rounded or geometric in shape or, alternatively, the sides of a base may instead be single circular wall including one or more of the cutouts described in more detail below spaced apart from each other along the circumference of the wall. However, example embodiments are not limited thereto and the first base 3 and the second base 4 may have a more angular shape, for example, a half-cube shape including the upper/lower surface of the cube and its four sides extending in the axial direction of the screw wire 5 from the upper/lower surface, and more or less than four sides.

The lower surface of the second base 4 includes a receiving hole 8. The receiving hole 8 is sized and configured to receive the screw wire 5. The hole 8 can be sized and configured to allow the second base 4 to rotate around the screw wire 5 outside of the threads of the screw wire 5.

The female receivers 2*a* and 6*a* of the first and second screw ends 2 and 6 which receive the ends of the screw wire 5 may be configured to extend at least partially into the receiving holes 7 and 8 of the first and second bases 3 and 4. That is, the receiving holes 7 and 8 have diameters wider than widths of the female receivers of the first and second screw ends 2 and 6.

One or more of the sides of the first base 3 include a cutout 9. One or more of the sides of the second base 4 corresponding to the side or sides of the first base 3 which include the cutouts 9 include a corresponding cutout 10. The cutouts 9 and 10 may have a desired or predetermined height and width, and the height and width of the cutouts 9 may be the same as the height and width of the cutouts 10.

The sides of the first base 3 and the sides of the second base 4 are configured to be connected together between the cutouts 9 and 10, and corresponding cutouts of the first base 3 and the second base 4 are combined to form receiving areas. Each receiving area is configured to hold a gem stone or other decorative item when the first base 3 and the second base 4 are connected together. For example, FIG. 1 shows each of the four sides of the first base 3 and the second base 4 having corresponding cutouts 9 and 10 that form four receiving areas for receiving four gem stones 11. The receiving areas are sized and configured such that when the first base 3 and the second base 4 are connected together between the cutouts, the gem stones 11 are held in place by the first base 3 and the second base 4 within the receiving areas. Ends of the sides of each base at the cutouts 9 and 10 may be ridged for seating the gem stones 11 or other decorative items in the ridges to hold the gem stones in place.

At ends of the sides between the cutouts 9 of the first base 3 and at ends of the sides between the cutouts 10 of the second base 4 are corresponding male and female connection means for connecting the first base 3 to the second base 4. If the first base 3 is configured to have female connection means, the second base 4 is configured to have male connection means. Alternatively, if the first base 3 is configured to have male connection means the second base 4 is configured to have female connection means. The female connection means comprises a female receiver which may be one or more holes or notches 12 in the ends of the sides of the first base 3 between the cutouts 9 and facing the second base 4. The male connection means comprises a male connector which may be one or more pins 13 extending from ends of the sides of the second base 4 between the cutouts 10 and facing the first base 3. The female connection means comprises a notch 12 corresponding to each of the pins 13 of the second base 4. For example, FIG. 1 has four notches 12, one in between each of the cutouts 9, each notch 12 corresponding to one of the four pins 13 between the cutouts 10 of the second base 4. The notches 12 are sized and configured to receive the pins 13 to connect the first base 3 to the second base 4. The pins 13 sit in the notches 12 when the first base 3 and the second base 4 are connected together, and the gem stones 11 are secured between the first base 3 and the second base 4 in the receiving areas.

The jewelry system 1 is configured to form a jewelry article by connecting the second screw end 6 to the opposite end of the screw wire 5, i.e., by screwing the second screw end 6 to the screw wire 5. The second base 4 is added to the screw wire 5 by sliding the one end of the screw wire 5 through the hole 8 of the second base 4 with the ends of the sides of the second base 4 facing away from the second screw end 6. The second base 4 is moved along the screw wire 5 until it seats against the screw end 6. The gem stones 11 are seated in the cutouts 10 of the second base 4, e.g., in ridges in the ends of the sides at the cutouts 10 for holding the gem stones 11. The first base 3 is added to the screw wire by sliding the one end of the screw wire 5 through the hole 7 of the first base 11 with the ends of the sides of the first base 3 facing the second base 4. The first base 3 is moved along the screw wire 5 until it is connected to the second base 4. That is, the pins 13 of the second base 4 are inserted into the notches 12 in the first base 3 to connect first base 3 and the second base 4 together, and the gem stones 11 are secured between the first base 3 and the second base 4 in the receiving areas. The first screw end 2 is connected to the one end of the screw wire 5, e.g., by screwing the first screw end 2 to the screw wire 5.

At any time after completion of the jewelry article, the first screw end 2 or the second screw end 6 may be removed to allow modification or augmentation of the jewelry article. For example, the first screw end 2 and the first base 3 may be removed from the screw wire 5 to allow the gem stones 11 in the receiving areas to be replaced with different gem stones or other decorative items. After replacing the gem stones 11, the first base 3 may be replaced on the screw wire 5 and the first screw end 2 reconnected to the one end of the screw wire 5.

At least a portion of the first and second screw ends 2 and 6 located at the respective ends of the screw wire 5 have diameters wider than a diameter of the screw wire 5 and the receiving holes 7 and 8 to prevent the first base 3 and second base 4 from moving up or down in the axial direction of the screw wire 5 and falling off the ends of the screw wire 5. The length of the screw wire 5 may be cut after the second screw end 6, the second base 4, gem stones 11 and the first base 3 have been added to the screw wire 5 to ensure that the length of the screw wire 5 after the first screw end 2 is added is such that there is no excess length of the screw wire 5 between the first screw end 2 and the first base 3 and between the second screw end 6 and the second base 4. That is, the screw wire 5 may be completely hidden from view when the jewelry system 1 is fully assembled. The first and second screw ends 2 and 6 may be tightened on the respective ends of the screw 5 to create pressure against the upper and lower surfaces of the first and second bases 3 and 4 to prevent rotation of the first and second bases 3 and 4 about the screw wire 5.

Figure 2:
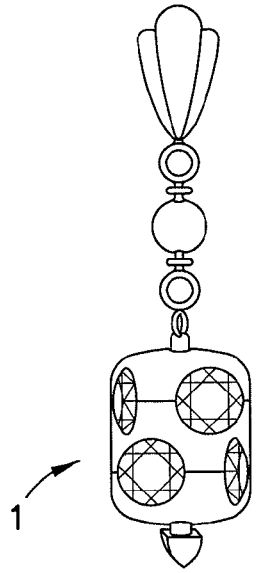
FIGS. 2A and 2 show exploded and assembled views of a modular jewelry system according to another example embodiment.
Figure 2A:
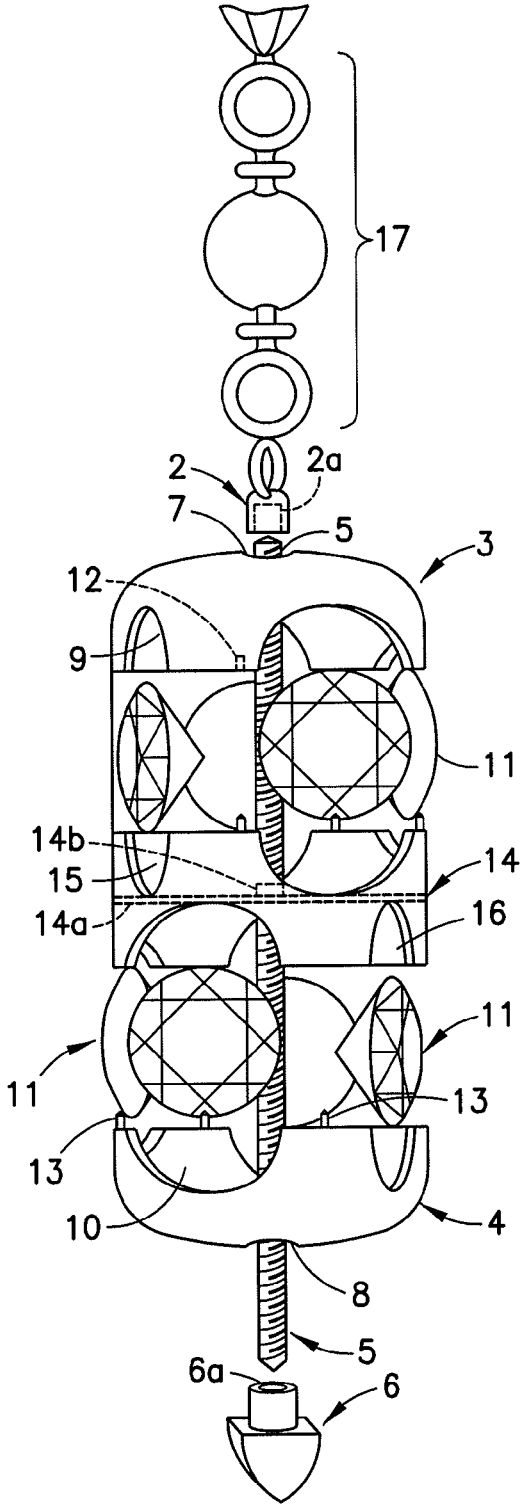

According to another example embodiment, the jewelry system 1 may further comprise a middle link 14 as shown in FIG. 2A and 2 (collectively referenced as "FIG. 2" unless separately identified. The middle link 14 comprises a middle surface 14*a* having sides extending therefrom in each direction along the axis of rotation of the screw wire 5, i.e., sides extending in a direction toward the first base 3 arranged at the one end of the screw wire 5 and directly adjacent to the first screw end 2 and sides extending in a direction toward the second base 4 arranged at the opposite end of the screw wire 5 and directly adjacent to the second screw end 6. Accordingly, if the middle link 14 is between the first base 3 and the second base 4 on the screw wire 5, the sides of the middle link 14 extend upward toward the first base 3 and downward toward the second base 4.

FIG. 2 shows a middle link 14 having a generally cap or bowl shape above and below the middle surface 14*a* with first sides extending in the axial direction of the screw wire 5 from the middle surface toward the first base 3 and second sides extending in the axial direction of the screw wire 5 from the middle surface toward the second base 4. Connections between each of the first sides and between each of the second sides may be rounded or geometric in shape or, alternatively, the first and the second sides may instead be a single circular wall including one or more of the cutouts described in more detail below spaced apart from each other along the circumference of the wall.

The middle surface 14*a* of the middle link 14 includes a receiving hole 14*b*. The receiving hole is sized and configured to receive the screw wire 5. The hole man be sized and configured to allow the first middle link 14 to axially rotate around the screw wire 5 outside of the threads of the screw wire 5.

One or more of the first sides of the middle link 14 extending toward the first base 3 and corresponding to the side or sides of the first base 3 including the cutouts 9 include corresponding cutouts or notches 15. The cutouts 9 and 15 may have a desired or predetermined height and width, and the height and width of the cutouts 9 may be the same as the height and width of the cutouts 15. One or more of the second sides of the middle link 14 extending toward the second base 4 and corresponding to the side or sides of the second base 4 including the cutouts 10 include corresponding cutouts or notches 16. The cutouts 9 and 16 may have a desired or predetermined height and width, and the height and width of the cutouts 9 may be the same as the height and width of the cutouts 16.

The first sides of the middle link 14 and the sides of the first base 3 are connected together between the one or more cutouts 9 and 15, and corresponding cutouts of the first sides of the middle link 14 and the first base 3 are combined to form receiving areas on one side of the middle link 14. Each receiving area is configured to hold a gem stone 11 or other decorative item when the middle link 14 and the first base 3 are connected together. For example, FIG. 2 shows each of the sides of the first base 3 and each of the first sides of the middle link 14 having corresponding cutouts 9 and 15 that form four receiving areas for receiving four gem stones 11. The receiving areas are sized and configured such that when the middle link 14 and the first base 3 are connected together between the cutouts, the gem stones 11 are held in place by the first base 3 and the middle link 14 within the receiving areas.

The second sides of the middle link 14 and the sides of the second base 4 are connected together, and corresponding cutouts 16 of the second sides of the middle link 14 and cutouts 10 of and the second base 4 are combined to form receiving areas on the other side of the middle link 14. Each receiving area is configured to hold a gem stone 11 or other decorative item when the middle link 14 and the second base 4 are connected together. For example, FIG. 2 shows each of the four sides of the second base 4 and the second sides of the middle link 14 having corresponding cutouts 10 and 16 that form four receiving areas for receiving four gem stones 11. The receiving areas are sized and configured such that when the middle link 14 and the second base 4 are connected together between the cutouts, the gem stones 11 are held in place by the second base 4 and the middle link 14 within the receiving areas.

The gem stones 11 are held in place by the first base 3 and the middle link 14, by the second base 4 and the middle link 14 and between adjacent middle links 14 in the case of multiple middle links 14 in the jewelry system 1 using a system of male and female receiving means and first and second screw ends 2 and 6 in the same manner as described above with respect to the first base 3 and the second base 4 as will be understood by one skilled in the art and, therefore, a more detailed description thereof is omitted in the interest of brevity.

According to another example embodiment, a plurality of the middle links 14 may be stacked on the screw wire 5 between the first base 3 and the second base 4. First sides of the middle link of the plurality of middle links 14 adjacent to the one end of the screw wire 5 are connected to the sides of the first base 3, and second sides of the middle link of the plurality of middle links 14 adjacent to the opposite end of the screw wire 5 are connected to the sides of the second base 4. The remainder of the middle links of the plurality of middle links have first sides connected to second sides of adjacent middle links, and second sides connected to first sides of adjacent middle links. Accordingly a stack of two or more middle links 14 may be formed between the first base 3 and the second base 4, and for each middle link 14 added to the stack a number of possible rows of receiving areas in the jewelry system 1 increases by one. For example, FIG. 2 shows two rows of receiving areas with the use of a single middle link 14. However, the use of two middle links 14 provides for three rows of receiving areas. Accordingly, example embodiments allow for customizable jewelry articles having a size, shape and number of decorative items which is selectable by a customer and easily modifiable by a jeweler.

As noted above, at any time after completion of the jewelry article, the first screw end 2 or the second screw end 6 may be removed to allow modification or augmentation of the jewelry article. For example, the first screw end 2 and the first base 3 may be removed from the screw wire 5 to allow the removal or addition of one or more of the plurality of middle links 14 to the screw wire 5. Accordingly, a size and configuration of the jewelry article may be modified and/or augmented after its completion. For example, rows of receiving areas may be added or subtracted from the jewelry article to allow customization by a jeweler.

Although example embodiments have been shown and described in this specification and figures, it would be appreciated by those skilled in the art that changes may be made to the illustrated and/or described example embodiments without departing from their principles and spirit. These and other such changes are intended to fall within the scope of the invention.

What is claimed is:

1. A jewelry system, comprising:

a screw wire;

a first screw end connected to a first end of the screw wire;

a second screw end connected to the other end of the screw wire;

a first base including a first surface, a first receiving hole in said first surface for receiving the screw wire and one or more first sides extending from the first surface in a first axial direction of the screw wire;

a second base including a second surface, a second receiving hole in said second surface for receiving the screw wire, and one or more second sides extending in an opposite axial direction of the screw wire opposite to the first axial direction;

wherein one or more of the first sides of the first base include at least one cutout, and one or more of the second sides of the second base corresponding to the sides of the first base include a corresponding cutout, wherein the first base and the second base are arranged on the screw wire between the first screw end and the second screw end and the first sides of the first base are connected to the second sides of the second base, the cutouts are aligned opposite each other forming one or more receiving areas, and wherein each receiving area is configured to hold a decorative item between the first base and the second base.

2. The jewelry system of claim 1, wherein one of the first screw end and the second screw end include threading for engaging the screw wire, the screw wire comprises a rod including threads, the screw wire being secured at said one of the first end to threading of the first screw end or at the other end to threading of the second screw end.

3. The jewelry system of claim 1, wherein at least one of the first screw end and the second screw end includes a connecting element for connection to another jewelry component.

4. The jewelry system of claim 3, wherein a rotating bead is connected to the connecting element.

5. The jewelry system of claim 1, wherein the first base has a generally cap or bowl shape and the one or more first base sides includes at least four first sides that gradually curve in the first axial direction of the screw wire from the first surface, and the second base has a generally cap or bowl shape and the one or more second base sides includes at least four second sides that gradually curve in the opposite axial direction of the screw wire from the second surface.

6. The jewelry system of claim 5, wherein second ends of the second sides of the second base at the cutouts include ridges to hold the decorative item.

7. The jewelry system of claim 5, wherein ends of the first sides between the cutouts of the first base comprise one of female connectors and male connectors, and ends of the second sides between the corresponding cutouts of the second base comprise the other of the female connectors and male connectors, and the first base is connected to the second base by the corresponding male and female connectors.

8. A jewelry system, comprising:

a screw wire;

a first screw end connected to a first end of the screw wire;

a second screw end connected to the other end of the screw wire;

a first base including a first surface, a first receiving hole in said first surface for receiving the screw wire and one or more first sides extending from the first surface in a first axial direction of the screw wire;

a second base including a second surface, a second receiving hole in said second surface for receiving the screw wire and one or more second sides extending in the opposite axial direction of the screw wire opposite to the first axial direction;

at least one middle link including a third surface, a receiving hole in said third surface configured to receive the screw wire, one or more upper sides extending from the third surface in the axial direction of the screw wire and one or more lower sides extending from the third surface in the opposite axial direction of the screw wire, wherein the at least one middle link is between the first base and the second base on the screw wire;

wherein one or more of the first sides of the first base include a first cutout, one or more of the upper sides of the third base corresponding to the first sides of the first base include a corresponding first cutout, one or more of the second sides of the second base include a second cutout, and one or more of the lower sides of the third base corresponding to the second sides of the second base include a corresponding second cutout, wherein the first base, the second base and the at least one middle link are arranged on the screw wire between the first screw end and the second screw end, wherein the first sides of the first base are connected to the upper sides of the third base, the first cutouts of the first base and the corresponding cutouts of the third base are aligned opposite each other forming one or more first receiving areas, wherein the second sides of the second base are connected to the lower sides of the third base, the second cutouts of the second base and the corresponding second cutouts of the third base are aligned opposite each other forming one or more second receiving areas, and wherein each of the first receiving areas is configured to hold a decorative item between the first base and the third base, and each of the second receiving areas is configured to hold a decorative item between the second base and the third base.

9. The jewelry system of claim 8, wherein the at least one middle link is a plurality of middle links.

10. The jewelry system of claim 9, wherein the plurality of the middle links are stacked on the screw wire between the first base and the second base, upper sides of the middle link of the plurality of middle links adjacent to the first end of the screw wire are connected to the first sides of the first base, lower sides of the middle link of the plurality of middle links adjacent to the opposite end of the screw wire are connected to the second sides of the second base, and the remainder of the middle links of the plurality of middle links have upper sides connected to lower sides of adjacent middle links and lower sides connected to upper sides of adjacent middle links.

11. The jewelry system of claim 8, wherein one of the first screw end and the second screw end include a threaded receiver for securing to the screw wire, the screw wire comprises a rod including threads, the screw wire configured to be connected at the first end into the receiver of the first screw end and connected at the other end into the receiver of the second screw end.

12. The jewelry system of claim 8, wherein at least one of the first screw end and the second screw end includes a connecting element for connection to another jewelry component.

13. The jewelry system of claim 12, wherein a rotating bead is connected to the connecting element.

14. The jewelry system of claim 8, wherein the first base has a generally cap or bowl shape and includes at least four first sides that gradually curve in the axial direction of the screw wire from the first surface, the second base has a generally cap or bowl shape and includes at least four second sides that gradually curve in the opposite axial direction of the screw wire from the second surface, and the at least one middle link has a generally cap or bowl shape above and below the third surface with upper sides extending in the axial direction of the screw wire from the third surface toward the first base and lower sides extending in the opposite axial direction of the screw wire from the third surface toward the second base.

15. The jewelry system of claim 8, wherein ends of at least one of the second sides of the second base at the second cutouts and the upper sides of the at least one middle link at the first corresponding cutouts comprise ridges to hold the decorative item.

16. The jewelry system of claim 8, wherein first ends of the first sides between the first cutouts of the first base comprise one of female connectors and male connectors, upper ends of the upper sides between the first corresponding cutouts of the middle link comprise the other of the female connectors and the male connectors, second ends of the sides between the cutouts of the second base comprise the other of the female connectors and male connectors, lower ends of the lower sides between the second corresponding cutouts of the middle link comprise the one of the female connectors and the male connectors, the first base is connected to the middle link by the corresponding male and female connectors, and the middle link is connected to the second base by the corresponding male and female connectors.

17. A jewelry system, comprising:

a screw wire;

a first screw end connected to a first end of the screw wire;

a second screw end connected to the other end of the screw wire;

a first base including a first surface, a first receiving hole in said first surface for receiving the screw wire and one or more first sides extending from the first surface in a first axial direction of the screw wire;

a second base including a second surface, a second receiving hole in said second surface for receiving the screw wire, and one or more second sides extending in an opposite axial direction of the screw wire opposite to the first axial direction;

wherein one or more of the first sides of the first base include at least one cutout, and one or more of the second sides of the second base corresponding to the sides of the first base include a corresponding cutout, wherein the first base and the second base are arranged on the screw wire between the first screw end and the second screw end and the first sides of the first base are connected to the second sides of the second base, the cutouts are aligned opposite each other forming one or more receiving areas, wherein one of the first screw end and the second screw end is connected to the screw wire by threading, and wherein each receiving area is configured to hold a decorative item between the first base and the second base.

18. The jewelry system of claim 17, wherein at least one of the first screw end and the second screw end includes a connecting element for connection to another jewelry component.

* * * * *